United States Patent [19]

Nyman et al.

[11] Patent Number: 4,923,569

[45] Date of Patent: May 8, 1990

[54] HYDRAULIC HEADBOX WITH AIR ATTENUATION CHAMBER LOCATED UNDER THE STOCK FLOW ROUTE

[75] Inventors: Tapani Nyman; Vesa Rommi, both of Karhula; Kai Wikman, Virkkala, all of Finland

[73] Assignee: Valmet-Ahlstrom, Inc., Karhula, Finland

[21] Appl. No.: 348,531

[22] Filed: May 8, 1989

[30] Foreign Application Priority Data

May 27, 1988 [FI] Finland ..... 882513

[51] Int. Cl.[5] ..... D21F 1/02

[52] U.S. Cl. ..... 162/339; 162/336; 162/340; 162/343

[58] Field of Search ..... 162/336, 337, 339, 340, 162/343, 380

[56] References Cited

U.S. PATENT DOCUMENTS

| | | | |
|---|---|---|---|
| 2,550,552 | 4/1951 | Goodwillie . | |
| 2,782,692 | 2/1957 | Boronow et al. . | |
| 3,598,698 | 8/1971 | Goddard | 162/340 |
| 4,166,759 | 9/1979 | Kirjavainen | 162/337 |
| 4,179,332 | 12/1979 | Ilmoniemi et al. | 162/380 |
| 4,414,062 | 11/1983 | Kirjavainen | 162/336 |
| 4,432,835 | 2/1984 | Waris et al. | 162/343 |

FOREIGN PATENT DOCUMENTS

| | | |
|---|---|---|
| 137868 | 4/1975 | Finland . |
| 763574 | 7/1978 | Finland . |
| 803048 | 4/1981 | Finland . |
| 205371 | 12/1966 | Sweden . |
| 363652 | 1/1974 | Sweden . |

*Primary Examiner*—Karen M. Hastings

*Attorney, Agent, or Firm*—Nixon & Vanderhye

[57] ABSTRACT

The invention relates to a headbox of a paper or board making machine, particularly a hydraulic headbox, which has an inlet header section (1) with a manifold tube section (2) and an equalizing chamber (3) in the stock suspension flow route, a turbulence generator section (4) following the equalizing chamber (3), after which a tapered slice section (8) is located, through which the stock suspension is discharged onto the wire. The headbox also has an attenuation chamber (6) for pressure variations, which defines one or several air spaces (7) under the flow channel of the stock suspension, the spaces being connected with the flow channel by way of a connecting channel (5). The air space or spaces (7) are preferably confined by subjacent frame structures including a bottom wall (16) and vertical walls (18) and walls (19) defining the flow channel from below.

9 Claims, 1 Drawing Sheet

HYDRAULIC HEADBOX WITH AIR ATTENUATION CHAMBER LOCATED UNDER THE STOCK FLOW ROUTE

BACKGROUND

The invention relates to a headbox of a paper and board making machine and, in particular, a hydraulic headbox comprising an inlet header section with a manifold tube section and an equalizing chamber in the stock suspension flow route, a turbulence generator section following the equalizing chamber, after which a tapered slice section is located, through which the stock suspension is discharged onto the wire.

It is known in paper and board making that the instantaneous variations in the velocity of the slice jet being discharged from the headbox cause detrimental variations of the grammage of the final product. These variations occur especially at the rotation frequencies or their multiples of various rotary components. It is also general knowledge that the hydraulic headboxes are particularly sensitive to disturbancies like those described above. It is known that when the velocity of the slice jet increases the absolute magnitude of the velocity variations has to be decreased.

In order to diminish the pressure variations described above, various arrangements and auxiliary equipment have been developed. These can roughly be divided into two main categories. The first category consists of auxiliary equipment which are separate damping devices and are thus not physically connected with the headbox. Devices like this are disclosed in, e.g., U.S. Pat. Nos. 4 116 259, 4 169 757 and 4 308 095, Finnish pat. appl. 137868, U.S. Pat. No. 4 179 332 and Finnish pat. appl. 803048. The second category consists of auxiliary equipment directly attached to the headbox or constituting integral elements of it. Devices like this are disclosed in, e.g., U.S. Pat. Nos. 4 162 189, 4 063 997 and 4 166 759, Finnish pat. appl. 763574 and Swedish pat. appl. 363 652. These known solutions are very costly.

SUMMARY OF THE INVENTION

The apparatus according to the invention belongs to the category of devices directly attached to the headbox. An essential part of the present invention is a tank for the attenuation of pressure variations, which is located essentially more favourably than in the prior art solutions described above.

The headbox according to the invention is mainly characterized in that the headbox also comprises a chamber for attenuation of pressure variations, which defines one or several air spaces under the flow channel of the stock suspension, the spaces being connected with the flow channel by means of a connecting channel.

BRIEF DESCRIPTION OF THE DRAWINGS

The FIGURE illustrates a side cross-sectional view of a headbox in accordance with an exemplary embodiment of the invention.

DETAILED DESCRIPTION OF THE DRAWING

Figure 1:
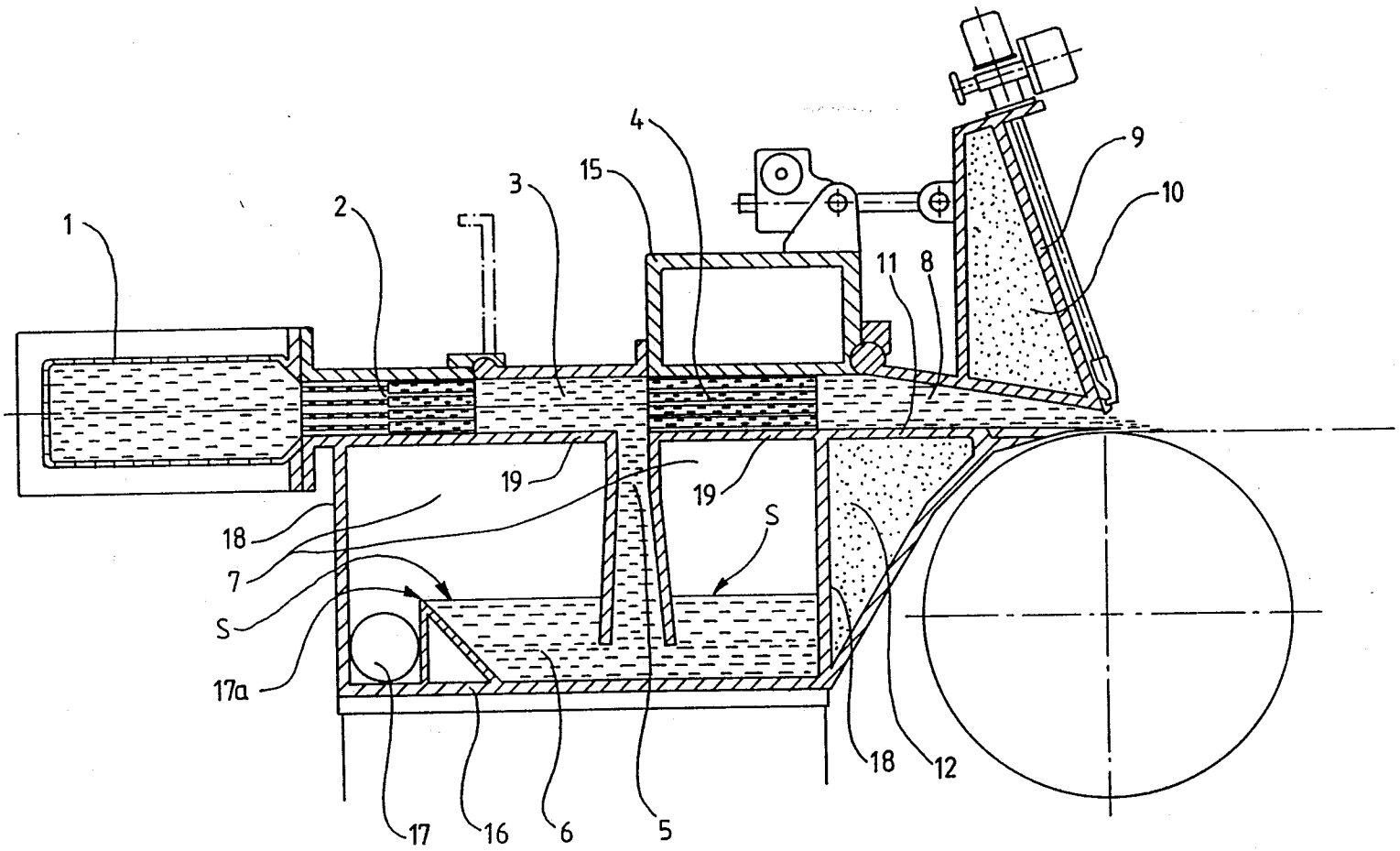

A preferred embodiment of the present invention is described below referring to the appended figure. The embodiment does not, however, exclude other solutions within the scope of the invention.

The figure shows a partially schematic view of the hydraulic headbox of a paper or board making machine.

The main components are an inlet header 1 for the stock suspension; a manifold tube section 2; an equalizing chamber 3, which is connected with a subjacent attenuation chamber 6 according to the invention through a flow channel 5; a turbulence generator 4; and a tapered slice channel 8. An air space 7 is confined within the attenuation chamber 6. The air space 7 and the attenuation chamber 6 are defined by a bottom wall 16, side walls 18, 18 and a top wall 19 which forms part of the header box. The attenuation chamber 6 functions as follows: part of the stock flowing from the equalizing chamber 3 is conducted downwardly through a flow channel 5 into the attenuation chamber 6. The stock initially flows below the liquid surface of the attenuation chamber 6 forming a so called water lock where air pressure in the space 7 rises as the level of stock rises. In the air space 7 such overpressure is maintained that prevents the stock surface S from rising too high. The overpressure is achieved in a manner known per se. The attenuation chamber 6 can be equipped with a dam 17a and an overflow outlet pipe 17, through which the stock is conducted away from the headbox (e.g., into a wire pit).

The embodiment of the invention shown in the figure is furnished with two air spaces 7 separated by the flow channel 5. The invention can also be carried out by an attenuation chamber having only one single air space. The attenuation chamber according to the invention functions in the same manner as other previously known attenuation chambers located above the stock flow elements, the flow channel or channels 5 acting according to the so called water lock principle.

A number of advantages are achieved with the invention compared to prior art solutions. First, the headbox does not have to be provided with a separate attenuation chamber since the existing structures of the headbox are utilized. This results in savings in material. Compared to previously known solutions, considerably more service room is left above the headbox, due to the location of the attenuation chamber below the stock flow components. For example, the equalizing chamber 3 can be provided with a cover that opens along the entire width of the headbox in order to facilitate cleaning. In addition, the heating system (described, e.g., in Finnish pat. appl. 831634) can be simplified and made more efficient by providing part of the bottom wall 16 with a mantle, within which water can be circulated through the water space 12 of the bottom slice beam 11 and the water space 10 of the top slice beam 9. Thus separate heat exchangers can be omitted altogether.

In the following, the claims are presented defining the invention within the scope of which the various details of the invention may vary.

What is claimed is:

1. A hydraulic headbox comprising:

means defining a stock suspension flow route, said means including, in sequence, an inlet header, a manifold tube section, an equalizing chamber, a turbulence generator and a tapered slice section for dispensing the stock suspension onto a wire;

said headbox further comprising an attenuation chamber for attenuating pressure variations in said stock suspension, said attenuation chamber located subjacent and intermediate the inlet header and tapered slice section of the flow route and including a connecting channel extending from said flow route to an inlet in a lower portion of said chamber, below a level of stock suspension in said chamber to thereby form an air space in said chamber above said level, said attenuation chamber further including an outlet in said lower portion.

2. The header according to claim 1 wherein said air space is divided into two sections, separated by said flow channel.

3. The headbox according to claim 1 wherein said attenuation chamber includes a dam adjacent said outlet.

4. The headbox according to claim 1 wherein said flow channel extends downwardly from said equalizing chamber portion of said flow route.

5. A headbox according to claim 1 wherein one wall of said attenuation chamber also comprises one wall of a coolant chamber located below said tapered slice section.

6. In a hydraulic headbox comprising an inlet header, a manifold tube section, an equalizing chamber and a tapered slice section which collectively form a flow route for a stock suspension, the improvement comprising an attenuation chamber located below said stock flow route and including means defining a pair of air spaces separated by a connecting channel extending between said stock flow route and said chamber.

7. A headbox according to claim 6 wherein said connecting channel extends substantially vertically between said equalizing chamber and said attenuation chamber.

8. A headbox according to claim 6 wherein a top wall of said attenuation chamber forms a bottom wall for at least said manifold tube section and said equalizing chamber.

9. A headbox according to claim 6 and further including upper and lower coolant chambers located, respectively, above and below said tapered slice section, and wherein a front wall of said attenuation chamber comprises one wall of said lower coolant chamber.

* * * * *